United States Patent [19]

Fredd

[11] 4,289,201

[45] Sep. 15, 1981

[54] WELL TEST APPARATUS

[75] Inventor: John V. Fredd, Dallas, Tex.

[73] Assignee: Otis Engineering Corporation, Dallas, Tex.

[21] Appl. No.: 68,213

[22] Filed: Aug. 20, 1979

[51] Int. Cl.[3] ..... E21B 43/00

[52] U.S. Cl. ..... 166/183; 166/184; 166/321; 137/540; 251/12

[58] Field of Search ..... 166/184, 183, 319, 321; 137/535, 540; 251/12, 57

[56] References Cited

U.S. PATENT DOCUMENTS 3,065,794 11/1962 Page ..... 166/321

3,434,535 3/1969 Page ..... 166/321

*Primary Examiner*—James A. Leppink

*Attorney, Agent, or Firm*—Vinson & Elkins

[57] ABSTRACT

A well test apparatus in which a by-pass sleeve valve lands in a previously set packer. A lock mandrel assembly lands in the sleeve valve and carries a transducer fitting. A transducer is releasably carried in the fitting. Well conditions such as pressure may be sensed by the transducer and recorded or transmitted to the surface. By manipulation of casing pressure, the by-pass valve may be opened and closed to flow the well at high production rates with the transducer in place.

7 Claims, 2 Drawing Figures

WELL TEST APPARATUS

Figure 1:
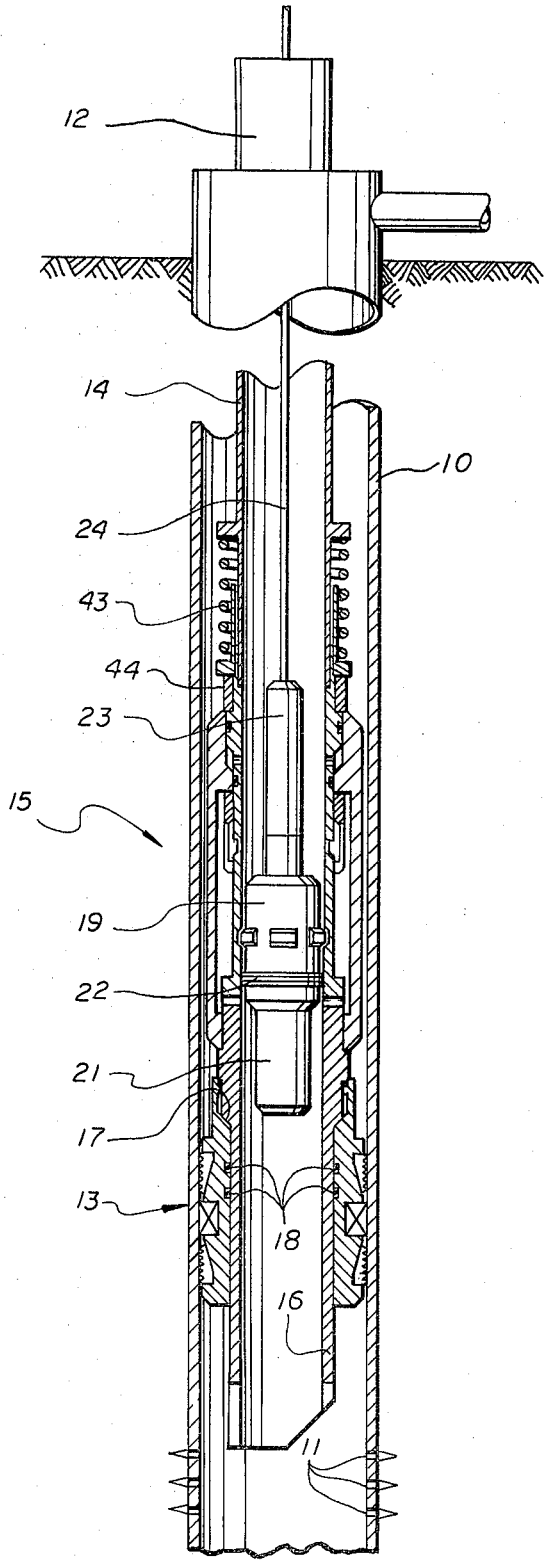

This invention relates to apparatus for testing a petroleum well.

During a well test program it is desirable to be able to determine at the bottom of the well certain well conditions such as pressure, temperature and the like, and the present state of the art provides this function with a transducer, which may be run into the well and record conditions adjacent the producing formation. See United States Patents to Kingelin, U.S. Pat. No. 4,051,897 and No. 4,134,452.

It is also known to provide with a bottom hole pressure system provisions for flowing the well at high rates to provide further test data. These past systems have provided manipulation of the tubing, complex motors run on testing tools and the like.

It is desirable in conjunction with a testing procedure to provide for shutting in the well adjacent the producing formation to obtain information and it is also desirable to flow the well to obtain additional information. For this latter purpose, a simple apparatus which may be provided as a part of the tubing string and controlled by varying annulus pressure is needed. The apparatus should provide for flow around the sensing device at the desired rates for test purposes and should provide a full open bore to permit the apparatus to be left in the well as a part of the tubing string after the test procedures have been carried out if the operator so desires.

It is an object of this invention to provide a by-pass valve apparatus which may be run on a tubing string as a part thereof, which may sealingly engage a packer, which provides for landing of a transducer and shutting in of the well adjacent the packer to obtain well information such as pressures, together with the ability to by-pass the pressure sensing device to provide for flow from the well at high rates.

Another object is to provide a by-pass valve having a seal area for sealingly receiving equipment to determine conditions in the bottom of the well and providing by-pass passageways around this seal area which are controlled by a valve responsive to changes in casing-tubing annulus pressure.

Other objects, features and advantages of the invention will be apparent from the drawing, the specification and the claims.

Figure 2:
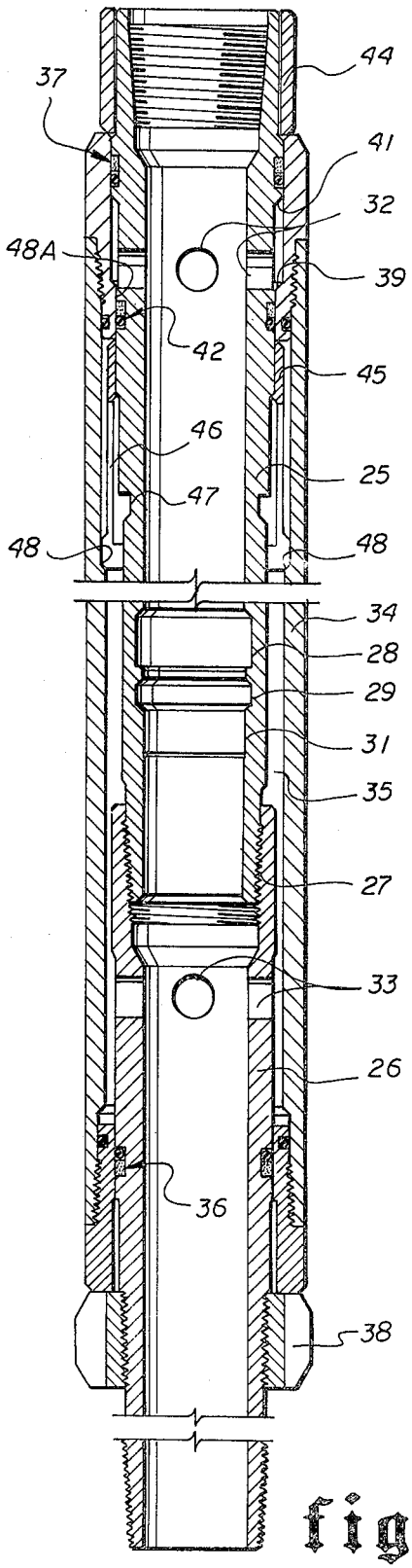

In the drawings wherein an illustrative embodiment of this invention is shown, and wherein like reference numerals indicate like parts, FIG. 1 is a schematic view partly in cross-section and partly elevation of apparatus in accordance with this invention shown installed in a cased well; and FIG. 2 is a cross-sectional view of the preferred form of by-pass valve.

In FIG. 1 there is shown a well having the conventional casing 10 which has been perforated at 11 to permit flow from the producing formation. Indicated schematically at 12 is the conventional wellhead equipment utilized during testing of a petroleum well.

Within the well there is shown a packer indicated generally at 13 which is conventional in form and preferably of the variety which is run and set by wireline.

Within the well there is a tubing 14 which carries at its lower end the by-pass test assembly indicated generally at 15. This assembly stabs into and seals with the packer. In the form shown the by-pass valve assembly 15 has a stinger or tailpipe 16 which lands in and is supported in the packer on the no-go shoulder 17. The valve 15 may be higher in the well and the tailpipe may be a string of tubing. Suitable seals 18 seal between the tailpipe 16 and the packer to provide fluid tight integrity so that formation fluid will be conveyed upwardly through the tubing to the surface.

Within the by-pass assembly there is landed a conventional lock mandrel 19 having depending therefrom a transducer fitting 21. The lock mandrel has suitable seals 22 which seal with the bore of the by-pass valve to prevent flow past the lock mandrel assembly. The transducer 21 may be of the type in which substantially no flow may occur, such as the type of transducer fittings shown in the above identified Kingelin patents, or it may be of the type in which limited flow is provided through the transducer into a collecting chamber to collect a sample of fluid, if desired. For a suitable transducer fitting of this type, reference is made to my co-pending application for United States Patent for "VALVE", executed the 28th day of June, 1979, the disclosure of which is incorporated herein by reference in its entirety.

Shown within the lock mandrel assembly 19 and transducer fitting 21 is a transducer 23, which senses pressures, temperature and the like and may record them on suitable equipment within the transducer, or may preferably transmit same back through the electric line 24 to the surface for suitable recording. As shown in my above identified co-pending patent application, or in the Kingelin patents, the transducer, such as transducer 23, is sealingly landed in the transducer fitting 21 to sense well conditions adjacent the producing formation.

In FIG. 2 the preferred form of by-pass valve is illustrated. The valve body is made up of the upper and lower tubular body sections 25 and 26 which are secured together as by the threaded connection 27. The body is provided at an intermediate point with a pair of grooves 28 and 29 in the bore of the upper body section 25, which provide a landing nipple configuration. Immediately below the landing nipple configuration is a polished section 31 of the bore, which is designed to seal with the seal 22 (FIG. 1) on the lock mandrel 19. With the lock mandrel in place and the transducer 23 and transducer fitting 21 blocking passage through the lock mandrel, the bore through the by-pass valve is closed.

In order to provide for flow of fluid through the by-pass valve with its bore closed, a suitable by-pass passageway is provided in the valve body. Preferably, ports 32 extend through the upper body section 25 and like ports 33 extend through the lower body portion 26. A sleeve valve member 34 is sealingly reciprocal with the valve body and with the valve body provides the by-pass passageway 35, which is the annulus between the valve body and the sleeve 34 together with the ports 32 and 33. The passageway is completed by suitable seals with the seal indicated generally at 36 sealing between the lower body section 26 and the lower end of the sleeve 34 and a seal indicated generally at 37 sealing between the upper end of the sleeve 34 and the upper body portion 25. The travel of the sleeve 34 is limited so that these two seals 36 and 37 are never uncovered and are always sealingly engaged by the sleeve to confine fluids to the by-pass. Downward movement of the sleeve 34 is limited by the sleeve engaging an abutment nut 38. Upward movement of the sleeve is limited by shoulder 39 on the sleeve engaging shoulder 41 on the upper body member 25 to thus keep the sleeve continuously in sealing engagement with the seals 36 and 37.

In accordance with this invention, valve means are provided controlling flow through the passageway 35. Preferably, this valve means is provided by the sleeve 34 engaging the seal 42 on the exterior of the upper body portion 25. With such engagement the by-pass passageway is closed. When the sleeve member moves upwardly to uncover the seal 42 flow will occur through the by-pass 35.

It will be noted that seals 36 and 42 are of identical diameters and seal 37 is slightly larger in diameter than seals 36 and 42. This provides a pressure responsive area on the sleeve 34 which is responsive to exterior or casing pressure. It provides a like area internally of the sleeve which is responsive to tubing pressure. Thus, by raising the pressure within the casing-tubing annulus, the sleeve may be made to move upwardly uncovering seal 42 and opening the flow passageway 35.

Suitable resilient means are provided to oppose the force of the casing-tubing annulus pressure. Preferably, a spring 43 (FIG. 1) is effective on the sleeve 44 which is in abutment with the upper end of the valve sleeve 34 to urge the valve sleeve 34 downwardly.

As the seal 42 is subject to flowing fluid passing through the tubing and to changing pressure differentials, it is preferred that this seal be protected. For this purpose a shutter 45 is provided in the flow passageway 35. The shutter 45 carries a collet 46 which cooperates with the groove 47 in the upper body section 25 and with a shoulder 48 within the sleeve 34. As the sleeve 34 moves upwardly the collet 46 drops into groove 47 and releases the sleeve to permit it to move further without the collet and its associated shutter 45. This disengagement between the collet and sleeve 34 occurs after the shutter 45 has moved over the seal 42 to protect it from fluid passing through the passageway 35. When the sleeve 34 is moving downwardly to valve closing position it engages the upper end of the shutter 45 to force it from groove 47 as the seal surface 48*a* passes over the seal 42. In this manner the seal 42 is protected during reciprocation of the sleeve 48 between valve open and valve closed position and the shutter protects the seal from the flowing fluid while the valve is open.

In operation of the system the well packer 13 is first run and set as by conventional wireline or other techniques. The by-pass valve is made up on the lower end of the tubing and the tubing is run in the well and stabbed into the packer with the section 16 of the by-pass valve which may be a tailpipe or extension thereof moving into the packer and seating on no-go shoulder 17. The seals 18 seal with the packer to provide fluid tight integrity between the tubing 14 and the producing formation.

Prior to seating of the by-pass valve in the packer the well may be unloaded by circulating fluid between the casing-tubing annulus and the tubing or conventional dumping valves may be employed in the system to open upon seating of the by-pass valve in the packer and dump light fluid which has been carried in the tubing as it was run into the hole.

After the tubing is seated in the packer the lock mandrel 22 with its associated transducer fitting 21 is run into the well in the conventional manner, as by wireline, and latched in place in the lock mandrel grooves 28 and 29. The seal 22 seals between the mandrel and by-pass valve.

The transducer 23 is then run and landed in the transducer fitting 21. At this time all flow through the area 31 of the bore through the by-pass valve is prevented and fluid may pass through the transducer fitting 21 only to the extent of exerting fluid pressure on instruments within the transducer 23 unless a small collecting area is provided in the transducer to collect a sample to be later carried to the surface with the transducer fitting.

It is a feature of this invention that the lock mandrel assembly and associated transducer may be landed in the by-pass valve without difficulty by providing for flow through the by-pass valve during the landing of the lock mandrel. Where no flow is provided through the transducer fitting it is sometimes difficult to get the lock mandrel and transducer fitting to move down into proper position once the seals 22 begin to block fluid by-passing the lock mandrel. This problem can be solved by opening the by-pass valve to permit flow through the by-pass as the lock mandrel assembly is being seated. If the transducer fitting is open as taught in the Kingelin patents identified above, similar difficulty is possible in seating of the transducer. Again, if the by-pass valve is open at the time that the transducer is moving into the transducer fitting a fluid lock will not occur and the transducer will normally seat in the transducer fitting without difficulty.

With the transducer in place the operator at the surface may selectively open and close the by-pass valve by controlling the casing-tubing annulus pressure. Thus, with the pressure increased in the casing-tubing annulus the sleeve 34 moves to its up position to open by-pass 35 and permit the well to flow. It will be noted that several large by-pass ports 32 and 33 are provided so that flow from the formation will be unobstructed by the by-pass valve. Preferably, the flow area through these ports and the flow area through the passageway 35 are at least equal to the bore through a lock mandrel.

At the operator's discretion the casing pressure may be reduced to permit the spring 43 to return the sleeve valve 34 to closed position. The operator can then read the shut-in pressure and determine the build-up pressure curve from information transmitted to the surface by the transducer 23.

After testing has been completed, the transducer fitting 23 is pulled on its electric line 24 and the lock mandrel and associated transducer fitting may be removed with conventional wireline techniques. The well may now be produced in the conventional manner leaving the by-pass valve in place or the tubing may be pulled and the by-pass valve removed and the tubing re-run for conventional completion.

If desired, a plug may be seated in grooves 28 and 29 and production allowed by maintaining the by-pass valve open. This allows control of the well adjacent the producing formation.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A well test apparatus comprising, a by-pass valve having a tubular body with a tailpipe adapted to sealingly engage a well packer, said valve having a bore extending therethrough and a landing nipple configuration in said bore, a locking mandrel in said nipple configuration, said mandrel having seal means sealing with the bore through said body, said body having ports therein on opposite sides of said seal means, a sleeve valve member reciprocal with and seatingly engaging said body, said sleeve valve member providing with said body a by-pass passageway interconnecting said ports to by-pass fluid about said locking mandrel, said sleeve valve member controlling flow through said passageway, said sleeve valve member having pressure responsive areas responsive to the differential in pressure in said bore and exterior of said valve, resilient means urging said valve member against the force exerted by exterior pressure, and a transducer fitting in said locking mandrel.

2. The apparatus of claim 1 wherein a transducer is releasably mounted in said transducer fitting.

3. The apparatus of claims 1 or 2 in combination with a well packer and seal means between said by-pass valve and said packer.

4. The apparatus of claim 1 in which the by-pass valve is provided with shutter means to protect seals between the valve body and sleeve valve member which are located between said ports.

5. A by-pass valve comprising, a tubular body having a tailpipe adapted to sealingly engage a well packer, said valve body having a bore extending therethrough and at least one groove providing a landing nipple configuration in said bore, said bore providing a seal surface adjacent said groove, said body having ports extending therethrough on opposite sides of said seal surface, a sleeve valve member reciprocal on said body and sealingly engaging said body to confine fluid flowing between said ports, said sleeve valve member controlling flow of fluid through said ports, said sleeve valve member responsive to pressure differential in said bore and exterior of said valve, and resilient means urging said sleeve valve member against the force exerted by exterior pressure.

6. The valve of claim 5 in combination with a locking mandrel in said landing nipple configuration and a transducer fitting carried by said locking mandrel.

7. The apparatus of claim 6 in combination with a transducer removably supported in said transducer fitting.

* * * * *